United States Patent [19]

Russell

[11] Patent Number: 4,669,211

[45] Date of Patent: Jun. 2, 1987

[54] MUZZLE LOADING FIREARM, AND METHODS OF CONSTRUCTING AND UTILIZING SAME

[76] Inventor: Dale Russell, 2404 Ruby Rd., Mt. Pleasant, Mich. 48858

[21] Appl. No.: 756,274

[22] Filed: Jul. 18, 1985

[51] Int. Cl.[4] ..... F41C 7/00

[52] U.S. Cl. ..... 42/51; 42/69.01

[58] Field of Search ..... 42/51, 69 R, 83

[56] References Cited

U.S. PATENT DOCUMENTS

| | | | |
|---|---|---|---|
| 2,203 | 7/1841 | Heurteloup | 42/69 R |
| 84,224 | 11/1868 | Slotterbek | 42/69 R |
| 116,252 | 6/1871 | Albright | 42/69 R |
| 3,451,154 | 6/1969 | Goble | 42/51 |
| 3,577,667 | 5/1971 | Kern et al. | 42/51 |
| 4,447,977 | 5/1984 | Holmgren | 42/51 |

*Primary Examiner*—Charles T. Jordan

*Attorney, Agent, or Firm*—Irving M. Weiner; Joseph P. Carrier; Pamela S. Burt

[57] ABSTRACT

A muzzle loading firearm having a receiver for housing and supporting all moving parts of the firearm, and for accommodating either one or two barrels. In the two-barrel arrangement, an upper barrel is disposed in parallel directly above a lower barrel, and independent hammer and trigger mechanisms are provided to permit independent firing of the barrels. The receiver is formed with a flash transfer orifice communicating with each barrel, and in both the one-barrel and two-barrel arrangements a flash transfer orifice extends vertically to a lower surface of the receiver to operatively cooperate with a bottom-mounted hammer arrangement.

6 Claims, 4 Drawing Figures

MUZZLE LOADING FIREARM, AND METHODS OF CONSTRUCTING AND UTILIZING SAME

BACKGROUND OF THE INVENTION

1. Field of the Invention

The present invention relates generally to a muzzle loading firearm including a receiver adapted to house and support all moving parts of the firearm. More particularly, the receiver according to the invention has at least one flash transfer orifice formed therein, is adapted to have either a pair of barrels or a single barrel fixedly received therein, and accommodates the hammer (or hammers) and trigger assembly.

The terminology "muzzle loading firearm" as employed herein is intended to connote a firearm of the type which includes a barrel with a breech plug and having a firing chamber formed forwardly of the breech plug, the firing chamber communicating with a flash transfer orifice which permits the charge in the firing chamber to be ignited by means of a percussion cap mounted on a nipple attached to a bolster, for example. Such a firearm is adapted to fire a projectile by firing a charge of powder packed into the firing chamber, the firearm being loaded by introducing the powder charge and projectile from the muzzle end of the barrel.

2. Description of Relevant Art

Heretofore, muzzle loading firearms have been limited with respect to the barrel accommodating capacities thereof, i.e., such firearms which include receivers for receiving the barrel have been designed so as to preclude desirable plural barrel arrangements. In those arrangements which do provide for multiple barrel arrangements, for example, the operation of the firearm is limited by such factors as only simultaneous firing or a single firing means. Further, muzzle loading firearms have generally failed to incorporate a receiver for receiving either one or two barrels while also accommodating all the moving parts of the firearm as well as one or more flash transfer orifices. As such, known constructions have required relatively expensive and complicated mounting assemblies.

The muzzle loading firearms disclosed in the following United States patents are illustrative of known constructions which have generally suffered the foregoing shortcomings.

U.S. Pat. No. 2,441 discloses a muzzle loading firearm having multiple barrels which be fired simultaneously. A series of barrels are disposed parallel to each other with each barrel having a touch hole on its upper side. The touch holes are interconnected by a tubular piece of iron crossing the barrels, and firing of the barrels is limited to simultaneous firing of all barrels.

U.S. Pat. No. 4,065,866 discloses a muzzle loading firearm incorporating a bolster design wherein an enhanced securing of the breech plug is attained, however, no provision is made for more than one barrel.

U.S. Pat. No. 4,215,502 discloses a firearm having a double barrel which is rotatably supported on the stock. After firing one barrel, the second barrel is to be rotated into a firing position so as to operatively cooperate with the single hammer arrangement.

U.S. Pat. No. 4,283,874 discloses a muzzle loading firearm wherein firing is effected by a shot shell primer positioned within an ignition chamber and fired through a loosely locked but protective cup. No provision is made for accommodating more than one barrel in the firearm.

The present invention effectively overcomes the disadvantages attendant conventional muzzle loading firearms as set forth hereinabove.

SUMMARY OF THE INVENTION

The present invention provides a muzzle loading firearm comprising a receiver having a stock portion fastened to a rear end thereof, and a double barrel portion including an upper barrel and a lower barrel. The receiver is provided with an upper opening for receiving the upper barrel, and a lower opening for receiving the lower barrel, the upper and lower openings extending in parallel spaced relation with the lower opening disposed directly below the upper opening. The upper and lower barrels are fixedly secured within the upper and lower openings of the receiver, respectively. First means is provided for igniting a charge in the upper barrel, and second means is provided for igniting a charge in the lower barrel. The first means comprises an upper flash transfer orifice formed in the receiver so as to communicate between the exterior of the receiver and a rear portion of the upper barrel, and the second means comprises a lower flash transfer orifice formed in the receiver so as to communicate between the exterior of the receiver and a rear portion of the lower barrel. The first and second means further comprises first and second hammer means supported by the receiver and operatively disposed between the upper and lower flash transfer orifices and respective first and second trigger means supported by the receiver.

In a preferred embodiment, the muzzle loading firearm comprises a receiver provided with a lower cutout, a stock portion adapted to be fastened to a rear end of the receiver, and a double barrel portion including an upper barrel and a lower barrel. The receiver is provided with an upper elongated opening and a lower elongated opening extending below and in parallel with the upper elongated opening, and the double barrel portion is adapted to be fixedly secured to the receiver with the upper barrel received in the upper elongated opening and the lower barrel received in the lower elongated opening. The receiver has an upper flash transfer orifice formed therein so as to communicate between the exterior of the receiver and a rear portion of the upper barrel, and a lower flash transfer orifice formed therein so as to communicate between the exterior of the receiver and a rear portion of the lower barrel. First spring loaded hammer means operatively cooperates with the upper flash transfer orifice to provide a force for igniting an explosive charge in the upper flash transfer orifice, and second spring loaded hammer means operatively cooperates with the lower flash transfer orifice to provide a force for igniting an explosive charge in the lower flash transfer orifice. A trigger assembly is provided which includes first trigger means operatively means operatively cooperating with the second hammer means, the trigger assembly being disposed within the lower cutout of the receiver.

In another embodiment of the invention, there is provided a muzzle loading firearm comprising a receiver provided with a lower cutout, and a stock portion adapted to be fastened to a rear end of the receiver. The receiver is provided with an elongated opening extending substantially horizontally and opening on a forward face of the receiver, and a barrel is adapted to be fixedly secured within the elongated opening of the receiver. The receiver has a flash transfer orifice formed therein so as to communicate between the exterior of the receiver and a rear portion of the barrel disposed in the elongated opening. Spring loaded hammer means operatively cooperates with the flash transfer orifice to provide a force for igniting an explosive charged in the flash transfer orifice, and a trigger assembly is provided which includes trigger means operatively cooperating with the hammer means, the trigger assembly being disposed within the lower cutout of the receiver.

It is an object of the invention to provide a muzzle loading firearm with a unitary solid receiver adapted to accommodate all moving parts of the firearm.

Another object of the invention is to provide a muzzle loading firearm provided with upper and lower fixed barrels, each having an associated hammer means and trigger means so that the barrels can be fired independently of each other.

A further object of the invention is to provide a muzzle loading firearm with a unitary solid receiver formed with at least one flash transfer orifice communicating between the exterior of the receiver and a rear portion of each barrel, respectively.

The above and further objects, details and advantages of the invention will become apparent from the following detailed description when read in conjunction with the accompanying drawings.

DETAILED DESCRIPTION OF PREFERRED EMBODIMENTS

Figure 1:
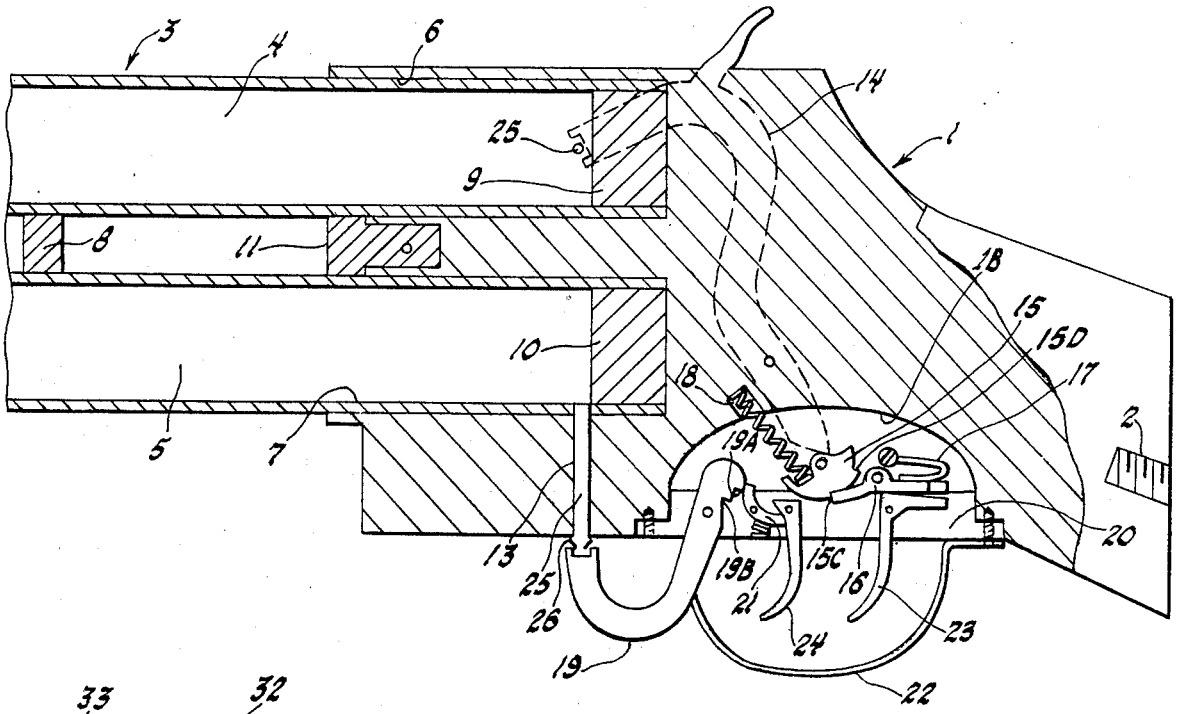
FIG. 1 is a cross sectional view of a muzzle loading firearm in accordance with a first embodiment of the invention.

With reference to FIG. 1, there is depicted a muzzle loading firearm in accordance with a first embodiment of the invention. The firearm includes a receiver 1 provided at the rear end thereof with a threaded bolt aperture 2, the aperture 2 being adapted to receive a bolt for fastening a wooden stock portion (not shown) to the rear end of receiver 1.

The receiver 1 has a unitary solid construction adapted to accommodate and support all moving parts of the firearm, as will be described in greater detail hereinbelow. Preferably, the receiver is fabricated of metal, such as steel or a chrome alloy, for example.

In the present embodiment of the invention, the receiver 1 is adapted to accommodate a double barrel portion 3 including an upper barrel 4 and a lower barrel 5. To this end, the receiver 1 is formed with an upper elongated opening 6 and a lower elongated opening 7, the lower opening 7 extending directly below and in parallel with the upper opening 6, and both openings 6, 7 extending substantially horizontally and opening on a forward face of the receiver 1.

The double barrel portion 3 has a unitary construction wherein the upper and lower barrels 4, 5 are joined along the lengths thereof by at least one cross piece 8. Formed at the rear ends of upper and lower barrels 4, 5 are respective breech plugs 9, 10. The double barrel portion 3 is fixedly attached to receiver 1 by inserting the upper barrel 4 in upper elongated opening 6 of receiver 1 and the lower barrel 5 in the lower elongated 7 of receiver 1, and then fastening a barrel attachment lug 11 within an intermediate aperture in receiver 1, by means of a pin.

The firing chambers of each of the upper and lower barrels 4, 5 are defined at the rear ends thereof, forwardly of the breech plugs 9, 10, respectively. A powder charge is loaded in the firing chambers of each barrel in a known manner, through the muzzle (or forward) ends of the barrels.

Communicating with the upper firing chamber in upper barrel 4 is a flash transfer orifice (not shown, but substantially the same as a bolster 13 formed in the lower barrel, as discussed below) which is formed in receiver 1 so as to extend. horizontally between the firing chamber of upper barrel 4 and the exterior of the right side wall of receiver 1. Communicating with the lower firing chamber in lower barrel 5 is a flash transfer orifice 13 which is formed in receiver 1 so as to extend vertically between the firing chamber of lower barrel 5 and the exterior of the lower surface of receiver 1.

Each of the flash transfer orifices 13 has a bolster 25 inserted therein having an orifice which communicates at the outer end with an associated nipple 26 attached thereto and which is threadedly engaged at the inner end thereof with the rear end of the associated barrel, thus further securing the barrel within the receiver. The nipple 26 supports a known percussion cap, for example, for igniting an explosive charge in the flash transfer orifices to fire the loaded charges in the barrels upon actuating of the hammer means as described hereinbelow.

The firearm of the FIG. 1 embodiment of the invention is provided with a first spring loaded hammer means operatively cooperating with the upper flash transfer orifice 12. Such means comprises an upper hammer 14 having the upper end thereof operatively associated with the nipple attached to the bolster 25 of upper flash transfer orifice. The lower end of hammer 14 is connected with a pivotal tumber 15 in a manner described hereinbelow.

The receiver 1 is formed with a lower cutout 1B which is adapted to accommodate therein the trigger assembly described hereinbelow, as well as portions of the spring loaded hammer means. In this respect, it will be noted that the upper hammer 14 is disposed outside the right side wall 1A of receiver 1.

Figure 2:
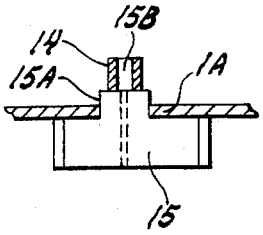
FIG. 2 is a cutaway cross sectional view of the tumbler and upper hammer of the first embodiment of the invention shown in FIG. 1.

As shown in FIG. 2, the generally moon-shaped tumbler 15 is pivotably supported by the right side wall 1A of receiver 1 such that a rounded protruding portion 15A of tumbler 15 extends through an aperture formed in right side wall 1A of receiver 1. A square projection 15B of tumbler 15 extends outwardly from protruding portion 15A, and is operably engaged with the lower end of upper hammer 14 by being received through a corresponding square aperture formed therein. Such engagement between the lower end of hammer 14 and the square projection of tumbler 15 imparts a pivotal rotation of tumbler 15 in the clockwise direction of FIG. 1 upon rearward pivoting of the upper end of hammer 14.

The first spring loaded hammer means further comprises a spring loaded sear 16 which is pivotably mounted to the right side wall 1A of receiver 1 and operatively cooperates at a rear end thereof with a sear spring 17 which is also supported by right side wall 1A of receiver 1. The forward end of sear 16 is in spring biased contact with the moon-shaped main part of tumbler 15 so as to be selectively engaged with either a first notch 15C thereof which corresponds to a half-cocked or safety position, or a second notch 15D corresponding to a fully-cocked position of upper hammer 14.

The forward side of tumbler 15 is operably engaged with one end of a coil spring 18 which is supported at the other end thereof by the right side receiver wall 1A. Upon rearward pivotal rotation of hammer 14, tumbler 15 rotates in the clockwise direction to permit cocking to the fully-cocked position wherein the forward end of sear 16 is engaged with notch 15D of tumbler 15.

The embodiment of FIG. 1 further includes second spring loaded hammer means comprising a lower hammer 19 having a first end thereof operably cooperating with the nipple attached to the bolster of lower flash transfer orifice 13. The lower hammer 19 is pivotably supported on a trigger assembly plate 20 which is threadedly fastened to the lower side of receiver 1 so as to close the aforementioned lower cutout 1B of receiver 1. A spring-biasing trigger guard member 22 has the rear end thereof fastened to trigger assembly plate 20, and the forward end thereof in spring-biasing engagement with a mid-portion of lower hammer 19. The trigger guard member 22 serves the dual functions of spring-biasing lower hammer 19, and protectively covering from below the triggers to be described hereinafter.

Lower hammer 19 has a second end thereof formed in a rounded shape and provided with a first notch 19A corresponding to a half-cocked or safety position and a second notch 19B corresponding to a fully-cocked position of lower hammer 19. In this respect, it will be understood that such second end of lower hammer 19 corresponds in function with the tumbler 15 of the first hammer means.

A second spring loaded sear 21 is pivotably supported by trigger assembly plate 20 such that the forward end thereof is selectively operably engaged in one of the notches 19A or 19B upon pivotal movement of lower hammer 19, the rearward end of sear 21 being spring biased by a spring supported by trigger assembly plate 20 as shown.

The trigger means in accordance with this embodiment of the invention includes a first trigger 23 pivotably supported by trigger assembly plate 20 such that a rear extension of trigger 23 operatively cooperates with the rear spring-biased end of sear 16. A second trigger 24 is pivotably supported by trigger assembly plate 20 such that a forward portion thereof operatively cooperates with the rear spring-biased end of sear 21.

After the upper barrel 4 of the firearm has been fully loaded and the hammer 14 cocked, and is thus ready to be fired, the rear trigger 23 is pressed to release engagement of sear 16 with notch 15D so that the upper end of hammer 14 forcibly contacts the charge mounted on the nipple attached to the bolster of the upper flash transfer orifice to ignite same and in turn fire the upper barrel. In a like manner, after the lower barrel 5 has been loaded and hammer 19 cocked, the forward trigger 24 is pressed to release engagement of sear 21 with notch 19B so that the first end of hammer 19 forcibly contacts the charge mounted on the nipple attached to the bolster of the lower flash transfer orifice 13 to ignite same and in turn fire the lower barrel.

It will be understood that the foregoing embodiment of the present invention affords a number of advantages. With respect to operation of the firearm, the independently operable first and second trigger means and corresponding hammer means for the respective upper and lower barrels 4, 5 permit independent firing of the upper and lower barrels as desired. It will be noted in this respect that each of the upper and lower barrels preferably have the same range, and the independent firing of same with both fully loaded in advance provides the user with the ability to take an immediate second shot at the target should the first shot miss the mark of otherwise prove ineffective.

In addition, the trigger assembly plate 20 fully supports both trigger mechanisms as well as the second (lower) hammer means and trigger guard, as well as serving to cover the lower cutout 1B of receiver 1. This arrangement greatly facilitates assembly, maintenance and access to the trigger and hammer components.

Further, the novel receiver according to the invention itself is formed with the flash transfer orifices communicating with the respective barrels, thus preventing damage to wooden parts as has been experienced with known arrangements. The receiver is also designed to effectively accommodate the upper and lower barrels therein, while also supporting all moving parts of the firearm.

Figure 3:
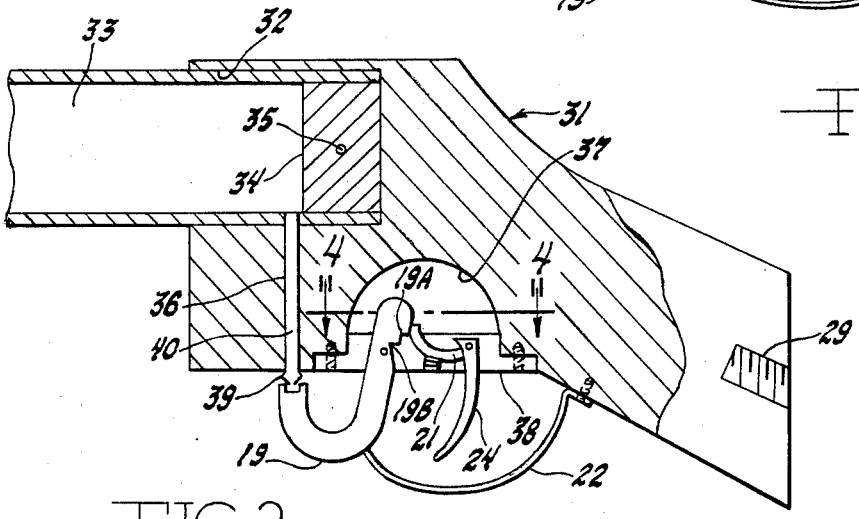
FIG. 3 is a cross sectional view of a muzzle loading firearm according to a second embodiment of the invention.
Figure 4:
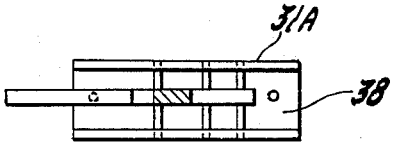
FIG. 4 is a view taken along line 4—4 in FIG. 3.

With reference to FIGS. 3 and 4, there will be described a second embodiment of the invention wherein the receiver is adapted to accommodate only a single barrel therein, although it will be understood that such barrel may be readily interchanged with other barrels to permit selective switching of calibers, for example.

In FIG. 3, there is shown a receiver 31 which is generally similar to the receiver 1 of FIG. 1 except that only a single barrel, hammer means and trigger means is provided. As with the receiver 1, the receiver 31 is adapted to be fastened to a wood stock portion via a threaded bolt hole 29.

The receiver 31 is provided with an elongated opening 32 within which is received an interchangeable barrel 33, the barrel 33 being provided with a breech plug 34 at the rear end thereof which defines a firing chamber forwardly thereof in the rear end of barrel 33. The barrel 33 is fixedly fastened within opening 32 by means of a pin 35.

The receiver 31 is formed within a flash transfer orifice 36 which may desirably be fitted with a bolster 40 extending at the inner end thereof into engagement with barrel 33 and at the outer end thereof into communication with a nipple 39 for receiving a percussion cap. Receiver 31 is also formed with a lower cutout 37 adapted to accommodate therein a portion of the hammer means and trigger means.

A trigger assembly plate 38 is adapted to cover the opening of cutout 37 from below, and pivotably supports sear 21 in the same manner that plate 20 supports sear 21 in the FIG. 1 embodiment. Also as in the FIG. 1 embodiment, the spring-biased sear 21 operatively cooperates at the rear end thereof with trigger 24 which is supported by plate 38, and at the forward end thereof with the notches 19A, 19B of the second end of hammer 19. The first end of hammer 19 operatively cooperates with the nipple of flash transfer orifice 36 in the same manner as described hereinabove with reference to FIG. 1. Also as in FIG. 1, the trigger guard 22 serves the dual function of protecting the trigger 24 and spring biasing the hammer 19.

It will be understood that the muzzle loading firearm of FIG. 3 functions in substantially the same manner as the second hammer means and trigger means of FIG. 1, i.e., of the lower hammer firing arrangement. As with the FIG. 1 embodiment, the FIG. 3 embodiment of the invention provides the advantage of ready assembly and access for the hammer and trigger assembly, and prevents any damage to wood parts upon firing. Additionally, the removable barrel arrangement permits interchanging of barrels for switching to different calibers, such as from 32 caliber through 50 caliber, if desired.

In the preferred embodiments, it is desirable that the dimensions for receiver 1 of FIG. 1 be approximately two or more inches high and somewhat larger than three inches in length, while the dimensions for receiver 31 of FIG. 3 are somewhat smaller, i.e., no less than two inches high and three inches or less in length.

Although there have been described what are at present considered to be the preferred embodiments of the invention, it will be understood that the invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

I claim:

1. A muzzle loading firearm, comprising:

a receiver provided with a lower cutout;

said receiver being adapted to have a stock portion fastened to a rear end thereof;

a double barrel portion including an upper barrel and a lower barrel;

said receiver being provided with an upper elongated opening, and a lower elongated opening extending below and in parallel with said upper elongated opening, both said openings extending substantially horizontally and opening on a forward face of said receiver;

said double barrel being adapted to be fixedly secured to said receiver with said upper barrel received in said upper elongated opening and said lower barrel received in said lower elongated opening;

said receiver having an upper flash transfer orifice formed therein so as to communicate between the exterior of said receiver and a rear portion of said upper barrel disposed in said upper elongated opening, and a lower flash transfer orifice formed therein so as to communicate between the exterior of said receiver and a rear portion of said lower barrel disposed in said lower elongated opening;

first spring loaded hammer means operatively cooperating with said upper flash transfer orifice to provide a force for igniting an explosive charge in said upper flash transfer orifice;

second spring loaded hammer means operatively cooperating with said lower flash transfer orifice to provide a force for igniting an explosive charge in said lower flash transfer orifice; and a trigger assembly including first trigger means operatively cooperating with said first hammer means and second trigger means operatively cooperating with said second hammer means, said trigger assembly being disposed within said lower cutout of said receiver;

said trigger assembly further including a trigger assembly plate adapted to be secured to said receiver so as to close said lower cutout thereof;

said first and second trigger means comprise first and second triggers pivotably supported by said trigger assembly plate so as to extend downwardly therefrom; and said second spring loaded hammer means comprises a lower hammer having a first end operatively cooperating with said lower flash transfer orifice, a spring loaded sear operatively disposed between a second end of said lower hammer and said second trigger, and a spring-biasing trigger guard extending below said first and second triggers and into contact at one end thereof with said lower hammer so as to spring load same.

2. A muzzle loading firearm according to claim 1, wherein:

said lower hammer, said second spring loaded sear, said first trigger and said second trigger are each pivotably supported by said trigger assembly plate.

3. A muzzle loading firearm according to claim 2, wherein:

said second end of said lower hammer is provided with a first notch corresponding to a half-cocked safety position of said lower hammer and a second notch corresponding to a fully-cocked position of said lower hammer; and said second spring loaded sear has one end thereof adapted to be selectively engaged with either of said first and second notches of said lower hammer upon pivotal movement of said lower hammer, and a second end thereof operatively cooperating with said second trigger to release engagement of said first end of said sear with said notches of said lower hammer upon actuation of said second trigger.

4. A muzzle loading firearm, comprising:

a receiver provided with a lower cutout;

said receiver being adapted to have a stock portion fastened to a rear end thereof;

said receiver being provided with an elongated opening extending substantially horizontally and opening on a forward face of said receiver;

a barrel adapted to be fixedly secured within said elongated opening of said receiver;

said receiver having a flash transfer orifice formed therein so as to communicate between the exterior of said receiver and a rear portion of said barrel disposed in said elongated opening;

spring loaded hammer means operatively cooperating with said flash transfer orifice to provide a force for igniting an explosive charge in said flash transfer orifice;

a trigger assembly including trigger means operatively cooperating with said hammer means, said trigger assembly being disposed within said lower cutout of said receiver;

said trigger assembly comprises a trigger assembly plate adapted to be secured to said receiver so as to close said lower cutout thereof;

said trigger means comprises a trigger pivotably supported by said trigger assembly plate so as to extend downwardly therefrom; and said hammer means comprises a hammer having a first end operatively cooperating with said flash transfer orifice, a spring loaded sear operatively disposed between a second end of said hammer and said trigger, and a spring-biased trigger guard extending below said trigger and into contact at one end thereof with said hammer so as to spring load same.

5. A muzzle loading firearm according to claim 4, wherein:

said hammer, said spring loaded sear and said trigger are each pivotably supported by said trigger assembly plate.

6. A muzzle loading firearm according to claim 5, wherein:

said second end of said hammer is provided with a first notch corresponding to a half-cocked safety position of said hammer and a second notch corresponding to a fully-cocked position of said hammer; and said spring loaded sear has one end thereof adapted to be selectively engaged with either of said first and second notches of said hammer upon pivotal movement of said hammer, and a second end thereof operatively cooperating with said trigger to release engagement of said first end of said sear with said notches of said hammer upon actuation of said trigger.

* * * * *

UNITED STATES PATENT AND TRADEMARK OFFICE

CERTIFICATE OF CORRECTION

PATENT NO. : 4,669,211

DATED : June 2, 1987

INVENTOR(S) : Dale RUSSELL

It is certified that error appears in the above-identified patent and that said Letters Patent is hereby corrected as shown below:

Column 2, line 58, delete "means operatively" (first occurrence);
line 58, after "cooperating" insert --with the first hammer means and second trigger means operatively--.
Column 6, line 12, change "of" to --or--.

Claim 4, line 32, (column 8, line 65), change "spring-biased" to --spring-biasing--;

Signed and Sealed this

First Day of December, 1987

*Attest:*

*Attesting Officer*

DONALD J. QUIGG

*Commissioner of Patents and Trademarks*